US006012258A

United States Patent [19]

Brown et al.

[11] Patent Number: 6,012,258

[45] Date of Patent: Jan. 11, 2000

[54] OFFICE PANELLING SYSTEM WITH INSERT MODULE

[75] Inventors: Mortimer Brown, Oakville; Ian B. Kuznick, Bolton, both of Canada

[73] Assignee: Teknion Furniture Systems Limited

[21] Appl. No.: 08/357,325

[22] Filed: Dec. 16, 1994

[51] Int. Cl.[7] ..... E04H 1/06

[52] U.S. Cl. ..... 52/239; 52/36.1; 52/204.69; 52/476; 52/773

[58] Field of Search ..... 52/239, 242, 36.1, 52/36.4, 36.5, 476, 773, 204.59, 656.5, 656.2, 204.69

[56] References Cited

U.S. PATENT DOCUMENTS

| | | | |
|---|---|---|---|
| 3,226,776 | 1/1966 | Van Worner | 52/36.4 X |
| 4,535,577 | 8/1985 | Tenser et al. . | |
| 4,539,243 | 9/1985 | Miller | 52/476 X |
| 4,942,805 | 7/1990 | Hellwig et al. | 52/239 X |
| 5,038,539 | 8/1991 | Kelley et al. . | |
| 5,046,284 | 9/1991 | Harper | 52/476 X |
| 5,207,037 | 5/1993 | Giles et al. | 52/239 X |
| 5,274,972 | 1/1994 | Hansen | 52/242 X |

*Primary Examiner*—Carl D. Friedman
*Assistant Examiner*—Timothy B. Kang

[57] ABSTRACT

A dominant and secondary component cooperate with an office panel frame to define a light transmitting port through the office panel frame. The dominant component is supported by the office panel frame and the secondary component is supported by the dominant component. The dominant and secondary components cooperate to provide improved safety features and more effectively distribute accidental forces to the office panel frame.

20 Claims, 7 Drawing Sheets

OFFICE PANELLING SYSTEM WITH INSERT MODULE

BACKGROUND OF THE INVENTION

Office panelling systems for subdividing office space to define different work areas have gained wide acceptance in North America. These systems are typically frame-based systems with releasable elements individually secured to the frames. A panelling system of this type is shown in our U.S. Pat. No. 4,535,577. This patent discloses a frame-based office panelling system where the frames have a series of horizontal members extending thereacross which are used to support and retain releasable elements. These elements, together with certain exposed portions of the frame, define a finished surface of the office panelling system. There are other frame-based systems which have an open rectangular frame and releasable elements are individually secured to the frame to effectively cover the office panel. The elements are releasably secured to the column members of the frame and the elements generally abut at opposed horizontal edges.

Office panelling systems also use releasable elements of varying configuration individually secured to the underlying frame. For example, some of these releasable elements include a series of horizontal slots to which a series of file trays or other accessories can be secured. It is also known to have a pair of opposed releasable elements secured on opposite sides of a frame define a light transmitting port through the frame of the office panel. This light transmitting port can include a single glass pane or double glass panes.

It has long been recognized that it is desirable to secure from the frames large rectangular accessories of a size similar to an element which render the work space more appropriate for the task to be carried out. The frames of the office panel are designed to support work surfaces to one side of the frame, support hanging overhead file cabinets, hanging file cabinets for desks, tackboards releasably secured between opposed vertical members of a frame, acoustical elements, easily cleaned elements having a hard exterior surface, and even elements which provide cooling of the work space or equipment in the work space.

Prior to the acceptance of frame-based office panelling systems covered with releasable elements, it was recognized that light transmitting office panels could improve the work space environment. Therefore, office panels which have a transparent portion through which light can transmit have been used for many years by many manufacturers.

In some office layouts, it is desirable to have a single pane of glass associated with one side of the office panel frame with the opposite side of the panel open. This arrangement exposes the interior surface of the glass pane to accidental or deliberate forces and can cause problems due to accidental removal thereof.

With existing systems, it is also difficult to achieve an accurate seam between components applied on opposite sides of the frame and which abut on an interior finished surface of a port through an office panel.

The present invention overcomes some of the disadvantages of the prior art systems. According to a preferred aspects, the office panel has improved safety characteristics and improved visual appearance.

SUMMARY OF THE INVENTION

An office panelling system according to the present invention comprises a series of mechanically connected office panels which cooperate and define an office work space.

Each of the panels have a support frame selectively covered by releasable elements applied to opposite sides of the frame and which define a finished surface. The office panelling system also includes insert modules each of which defines open or light transmitting ports through the panels. Each insert module has a dominant component and a secondary component. The dominant component is releasably secured to one side of the frame and forms part of an exterior surface of the respective panel. The secondary component is positioned to the opposite side of the frame and aligned with the dominant component. The secondary component provides a finished surface on the opposite side of the frame. The secondary component releasably engages and is supported by the dominant component.

According to a preferred aspect, the dominant and secondary components have overlapping surfaces which cooperate with each other to provide an accurate finished surface therebetween.

According to an aspect of the invention, the dominant portion includes a finished insert portion which extends fully through the frame concealing the interior of the frame from view.

According to a further aspect of the invention, the dominant portion includes an exterior trim frame which includes a slot about the interior perimeter of the transparent port of the insert module which slot engages and retains a glazed pane.

According to a preferred aspect of the invention, the secondary component includes a rectangular perimeter frame surrounding a light transmitting port.

According to yet a further aspect of the invention, the secondary component includes a glazed pane across the light transmitting port.

According to yet a further aspect of the invention, the dominant and secondary component cooperate to define a light transmitting port through the office panel.

According to yet a further aspect of the invention, the light transmitting port is an open pass-through port.

According to yet a further aspect of the invention, each of the secondary and dominant components cooperate to support a glazed pane which forms part of the finished surface.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
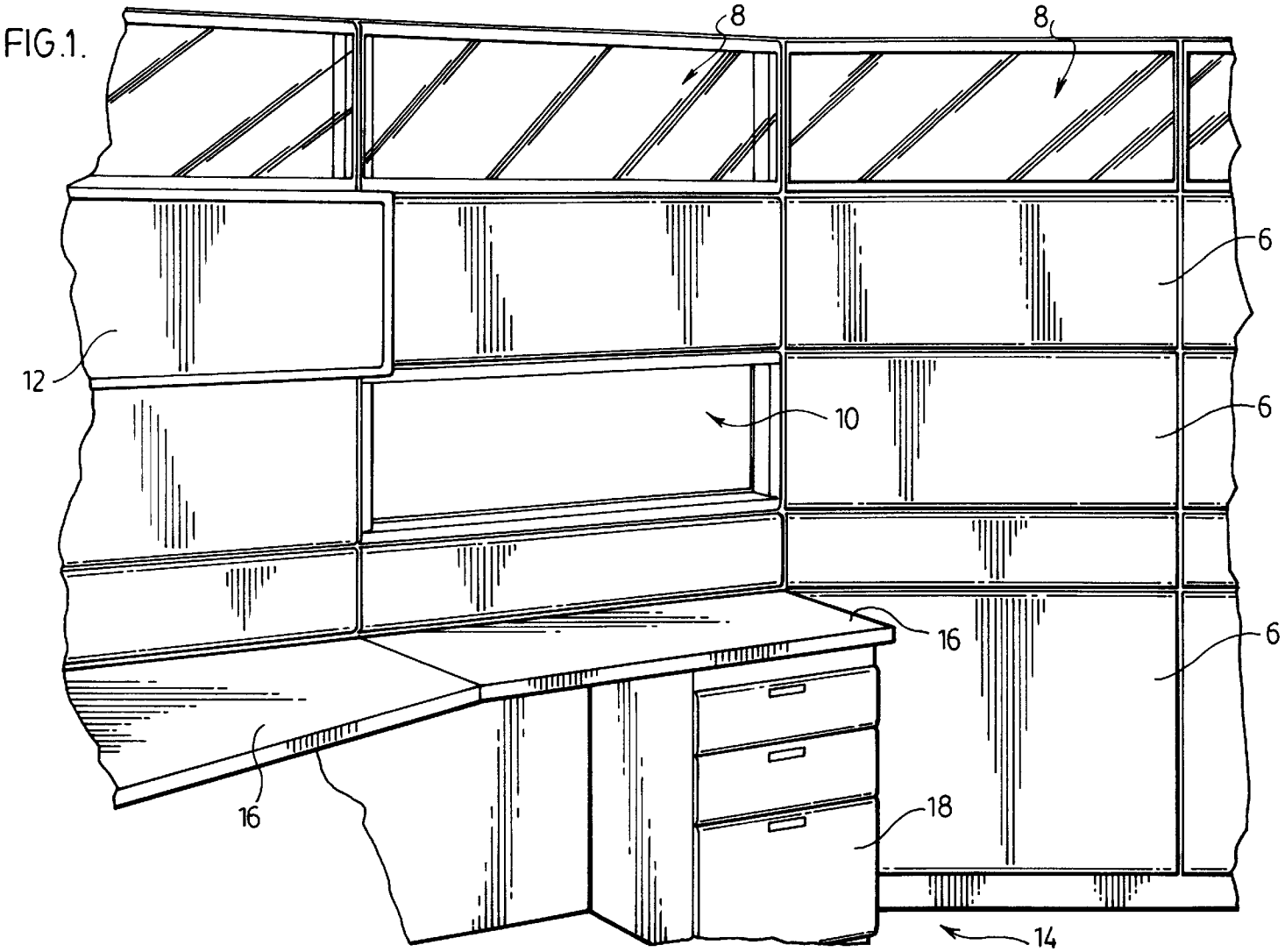
FIG. 1 is a partial perspective view of a series of connected office panels.

The office panelling system 2 is defined by a series of panels 4 which can be mechanically connected in a host of different configurations for defining a particular office work space, generally shown as 14. In this case, the office work space has work surfaces 16, a filing pedestal 18 and an overhead hanging cabinet generally shown as 12. There are a host of accessories which can be secured to the frames of the office panelling system for customizing the work space for the particular worker or task to be carried out. The releasable elements 6 are secured to frames of the office panelling system and define a finished surface and insert modules 8 are secured to the frames and defining a light transmitting port or a glazed window through an office panel frame.

Figure 2:
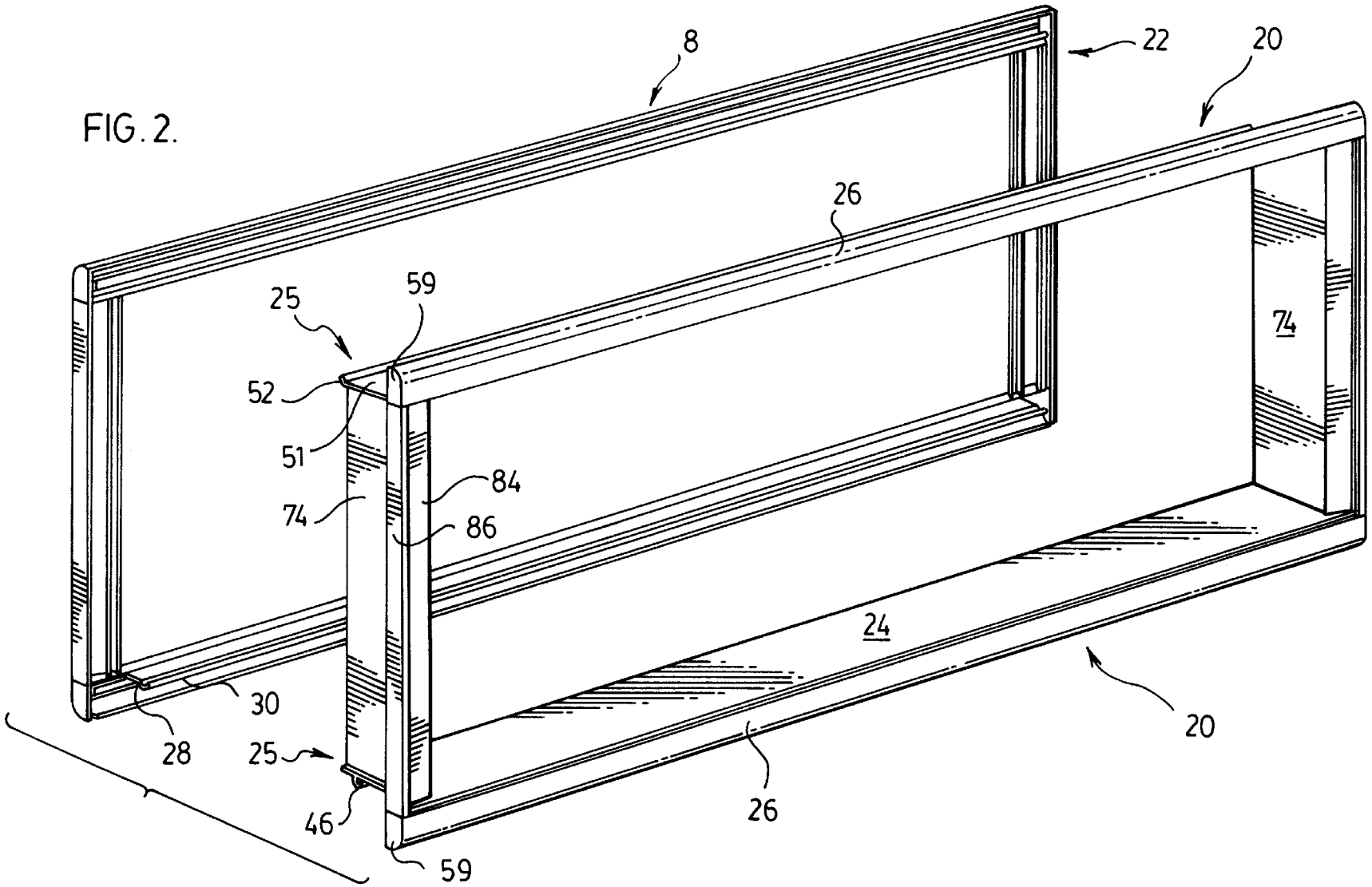
FIG. 2 is a perspective view of the insert module.

FIG. 2 shows a perspective view of the insert module 8 which is defined by a dominant component 20 and a secondary component 22. The secondary component 22 is adapted to engage and be supported by the interior edge 25 of the dominant component.

Figure 4:
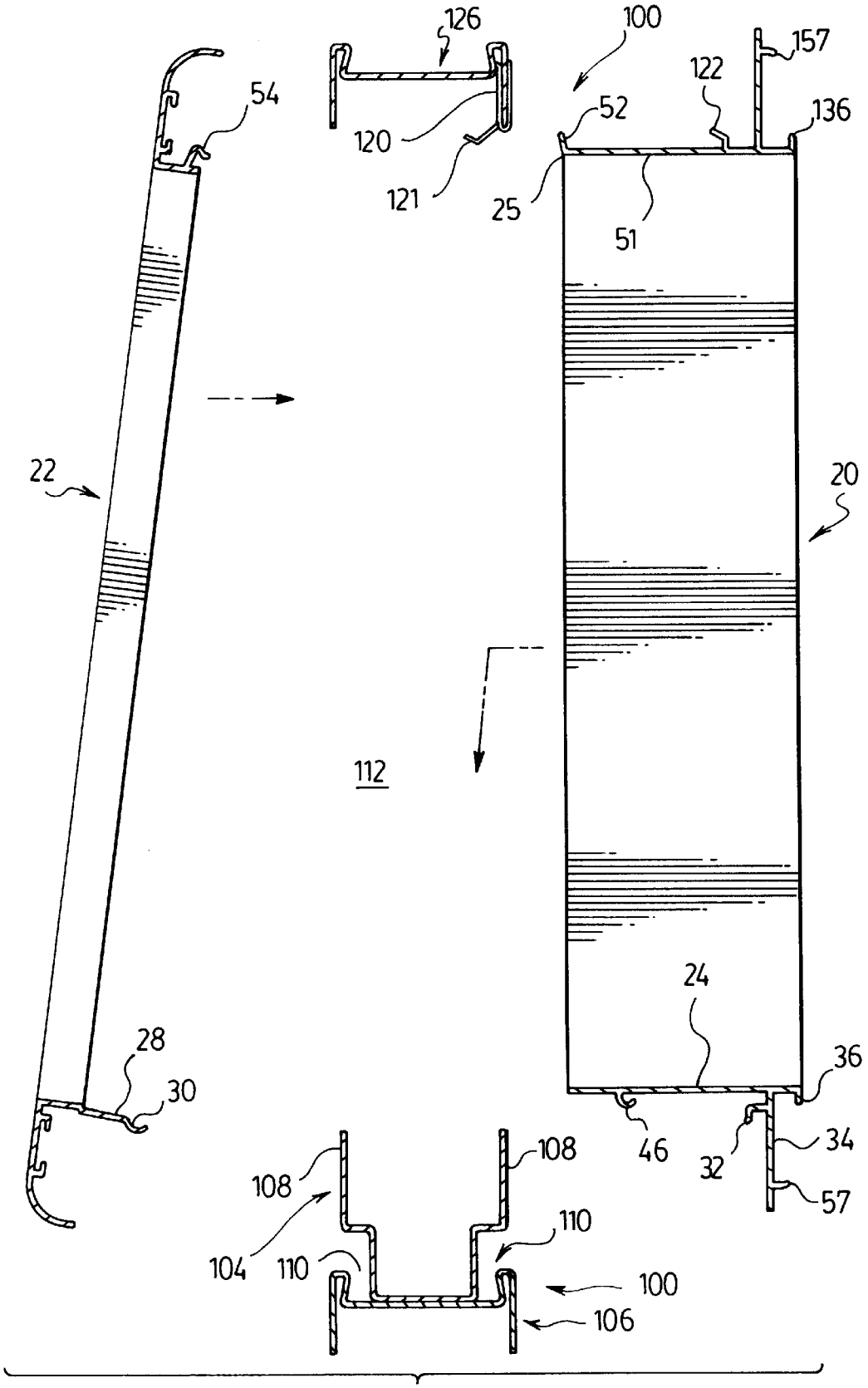
FIG. 4 is a sectional view showing the assembly of the insert module in the frame.
Figure 5:
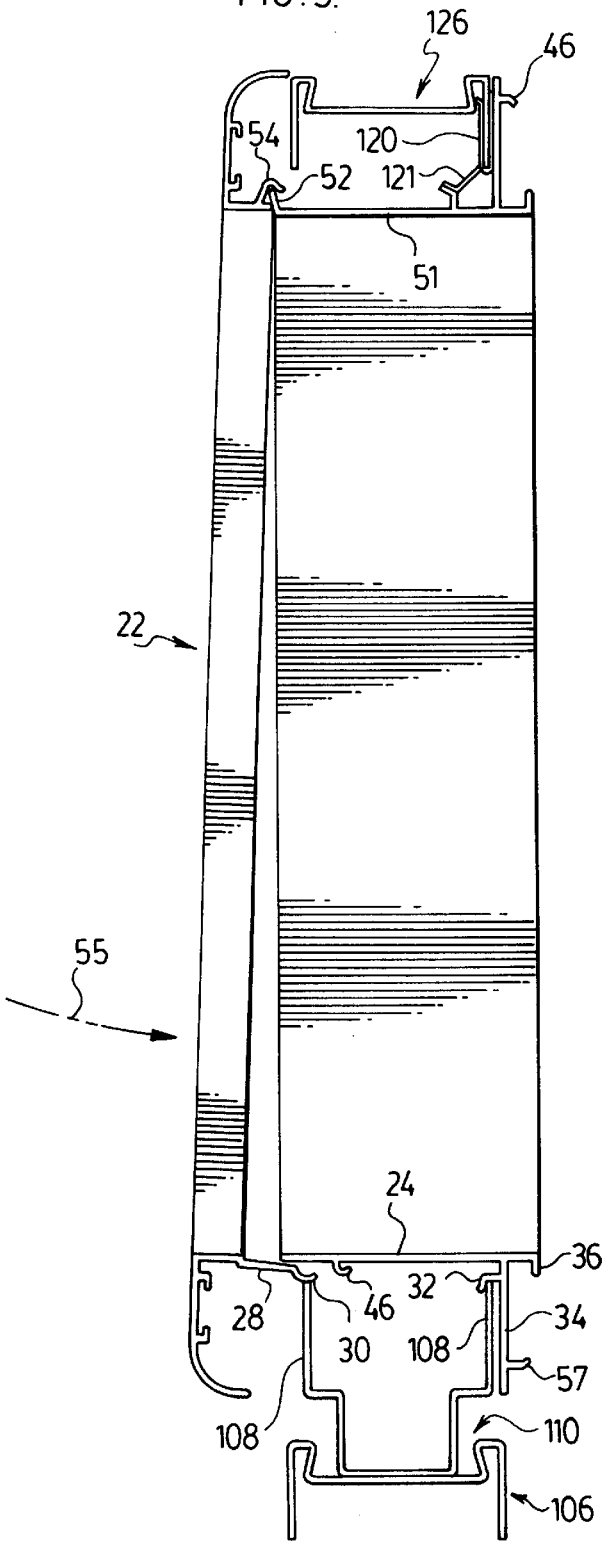
FIG. 5 illustrates securement of the secondary component to the dominant component.
Figure 6:
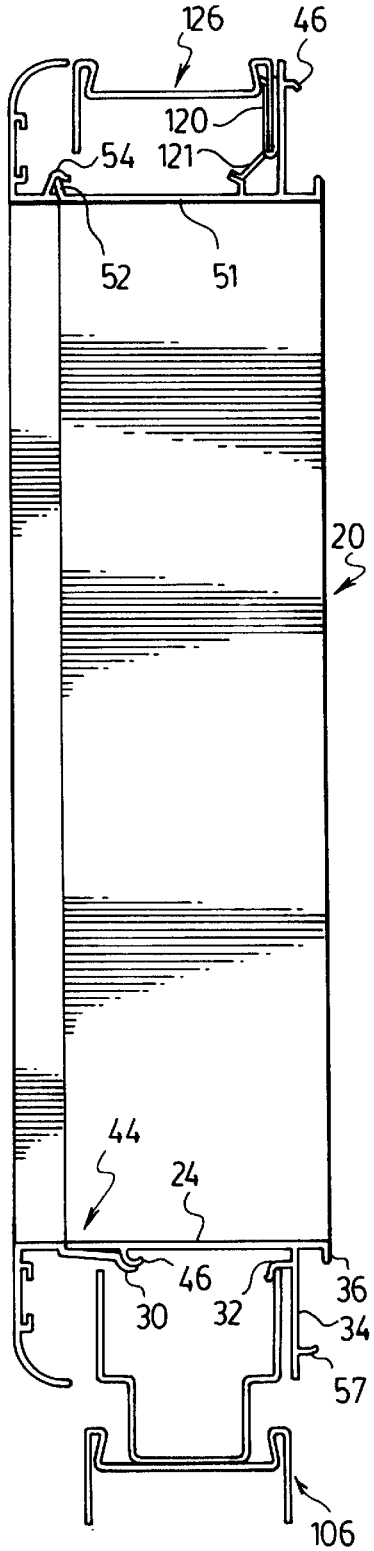
FIG. 6 shows the dominant and secondary components secured in an office panel frame.

FIGS. 4, 5 and 6 show the general method of securing of the insert module 8 to the frame of an office panel.

The actual frame of the office panel is of the type shown in our previous U.S. Pat. No. 4,535,577 and has a series of horizontal members extending thereacross, which define smaller rectangular cells in the frame. The rectangular cells are finished by releasable elements secured to the horizontal members or by insert modules inserted into the rectangular opening with dominant component secured to the frame. Each office panel has a frame, generally shown as 100. Only a portion of the frame is shown having an upper horizontal member 102 and a lower horizontal member which would be intermediate the height of the frame member 104 and 106. Member 104 is a "U" shaped channel member with upright legs 108. The upper edge of the "U" shaped channel 108 cooperates with and supports the dominant component of the insert module. Member 106 cooperates with the component 104 to define a recessed channel 110 which is accessible between releasable elements or between an insert module and a releasable element or between insert modules if they are vertically stacked. This slot can be used for hanging of filing cabinets or securing of desks, or securing panels at a particular angle to each other intermediate the length of a panel frame.

Figure 11:
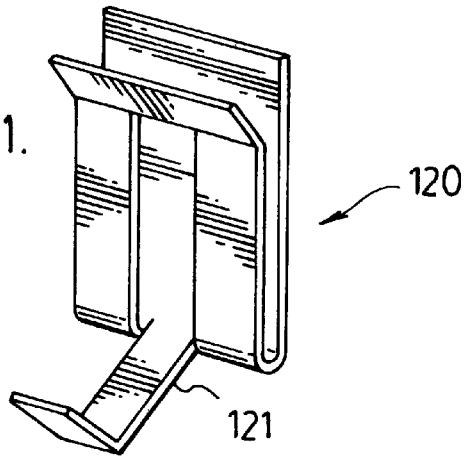
FIG. 11 is a perspective view of a spring clip.

To secure the insert module within the rectangular opening 112 intermediate the frame components 102 and 104, the dominant component is inserted into the opening in a manner to position the hook 32 behind the adjacent leg 108 of the channel 104. Once this hook has been placed on the upper edge of the leg, the dominant component may be rotated inwardly forcing securing flange 122 past the spring clips 120. Each spring clip 120 has spring arm 121 which moves past and is captured behind the securing flange 122 provided on the dominant component 20. A number of spring clips 120 are provided along the lower edge of component 102 to positively engage securing flange 122 and thereby maintain the dominant component in the assembled condition, as generally shown in FIG. 5. Spring clips are typically provided either end of the releasable element. Details of the spring clip 120 are shown in FIG. 11. The spring clips provide a bias maintaining the upper portion of the dominant component 20 in pressing contact with the face of the office frame. The exact placement of the spring clips is not critical, as securing flange 122 is continuous.

With the dominant component 20 initially secured within the rectangular opening 112 of the office panel frame, the secondary component 22 may be secured. The dominant component 20 includes the generally horizontal attachment surface 24 which extends through the frame to a position on the opposite side of the frame and slightly beyond of the frame for cooperating with the second component. The upper attachment section 54 at the free edge 25 includes upwardly extending latch flange 52 which provides a continuous support member for the continuous hook 54 provided on the interior surface of the secondary component 22. The latch flange 52 and the hook 54 run the horizontal length of attachment surface 51 and the secondary component, respectively, and define a continuous engagement. This considerable length improves the strength of the connection and distributes any forces more effectively and provides alignment at the upper portion of dominant and secondary components. This securement improves the accuracy of any seams between the secondary and dominant components, as will be more fully described.

Latch flange 52 and hook 54 have a pivot type relationship allowing the secondary component to be initially hooked on and subsequently rotated inwardly, as indicated by arrow 55. The lower portion of the secondary component includes a spring lock engagement with the lower attachment section 24, as shown in FIG. 6. The secondary component 22 at the lower edge thereof includes an inwardly directed spring arm 28 having a latch 30 provided at the end thereof. The latch 30 cooperates and is retained on the cam latch 46. The spring arm 28 is brought into engagement and forced over the cam latch 46 to the locked position of FIG. 7. In the locked position, the secondary component fully engages the dominant component. The spring arm 28, in the secured position, is spaced frpm the adjacent leg 108 of the horizontal frame member and is supported by the dominant component 20.

Figure 3:
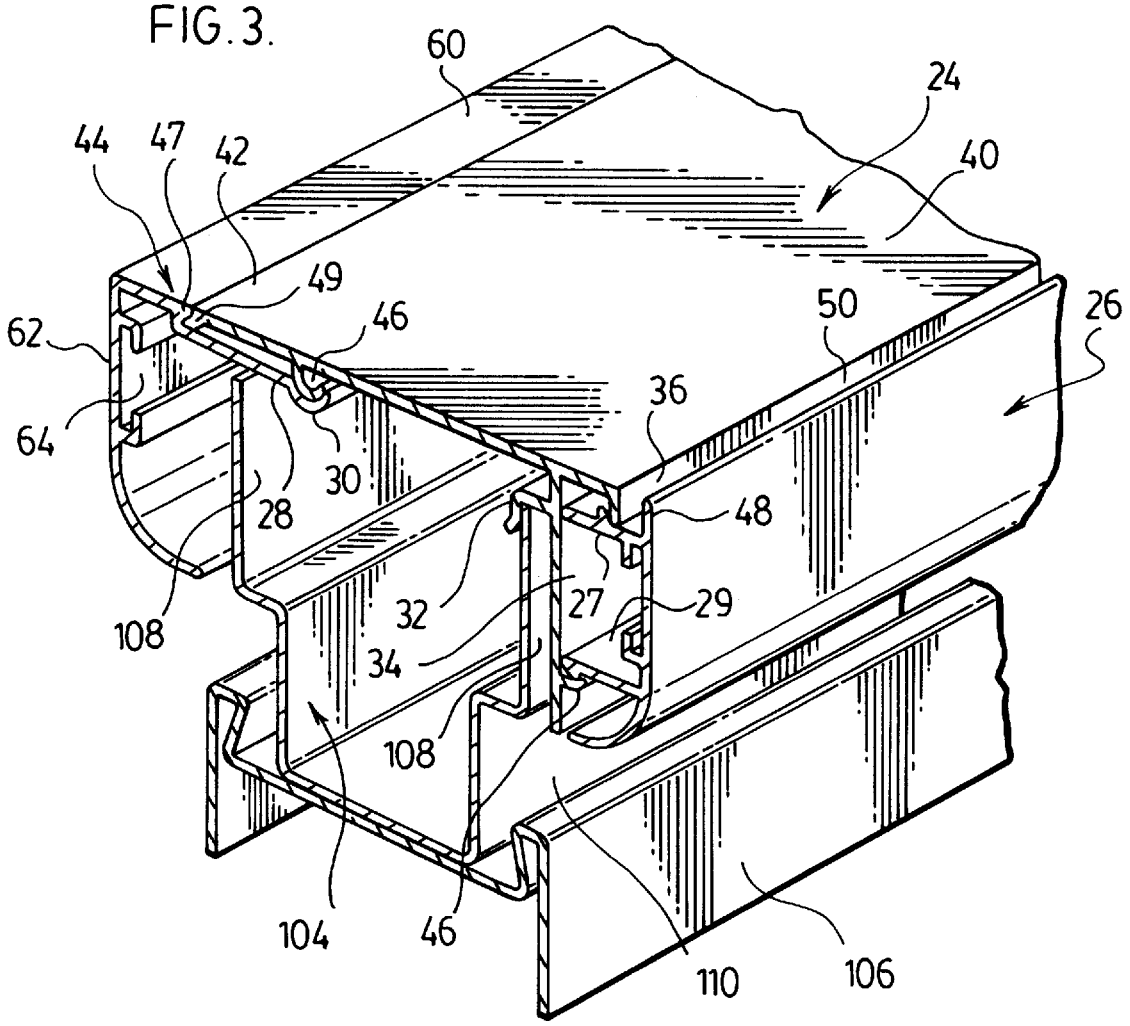
FIG. 3 is a partial perspective sectional view of the base of the insert module secured on a horizontal member of the frame of the office panel.

FIG. 3 illustrates the preferred overlapping continuous surfaces 47 and 49 of the second and dominant components which interlock to provide an accurate seam on the lower visible surface of the insert module.

The dominant component 20, as shown in FIGS. 5 and 6, is secured to the frame by a bottom pivot and hook arrangement and a top spring clip arrangement. The dominant component 20 includes a downwardly extending leg 34 which overlaps with the leg 108 of the office panel frame. Should the spring clip become inadvertently disengaged, the leg 34 will jam with leg 108 and limit the extent that the dominant component can partially rotate about the hook 32. Thus, leg 34 acts as a safety catch for the dominant component. In contrast, the secondary component 22 engages the dominant component through a top hook and latch arrangement, generally shown as 54 and 52, and a bottom spring detente arrangement provided adjacent the lower edge of the dominant and secondary components. With the secondary component secured to the dominant, the secondary component acts a safety stop for the dominant component. For example, should a very substantial load be exerted on the dominant component in trying to rotate it outwardly away from the frame about hook 32, the secondary component at the upper edge will bind with the frame and limit the extent of rotation. In this way, the secondary component provides a safety lock for the dominant component. The strength of this safety lock is high, as the hook 54 and latch 52 are continuous across the component.

Figure 9:
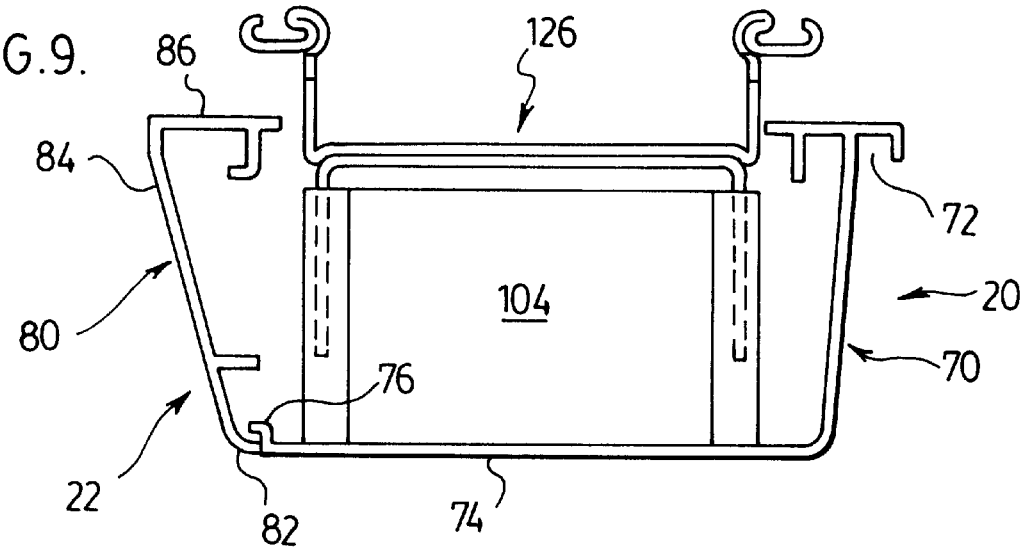
FIG. 9 is a sectional view through one of the vertical members of the insert module showing the construction thereof relative to the frame.

This is important with respect to the embodiment of FIG. 9 where the insert module is provided with a glazed pane 130 secured to the dominant component 22. In this structure, the interior surface 132 of the glazed pane 130 is exposed through the port in the office panel, and thus, forces could be inadvertently applied to this surface. Such forces can occur when the pane is being cleaned or could occur by accident should someone or something fall partially through the port and contact the interior surface 132. With the positive latch provided by the secondary component, the dominant component cannot inadvertently be removed frame and is positively held in position. The glazed pane is preferably of tempered glass.

Figure 7:
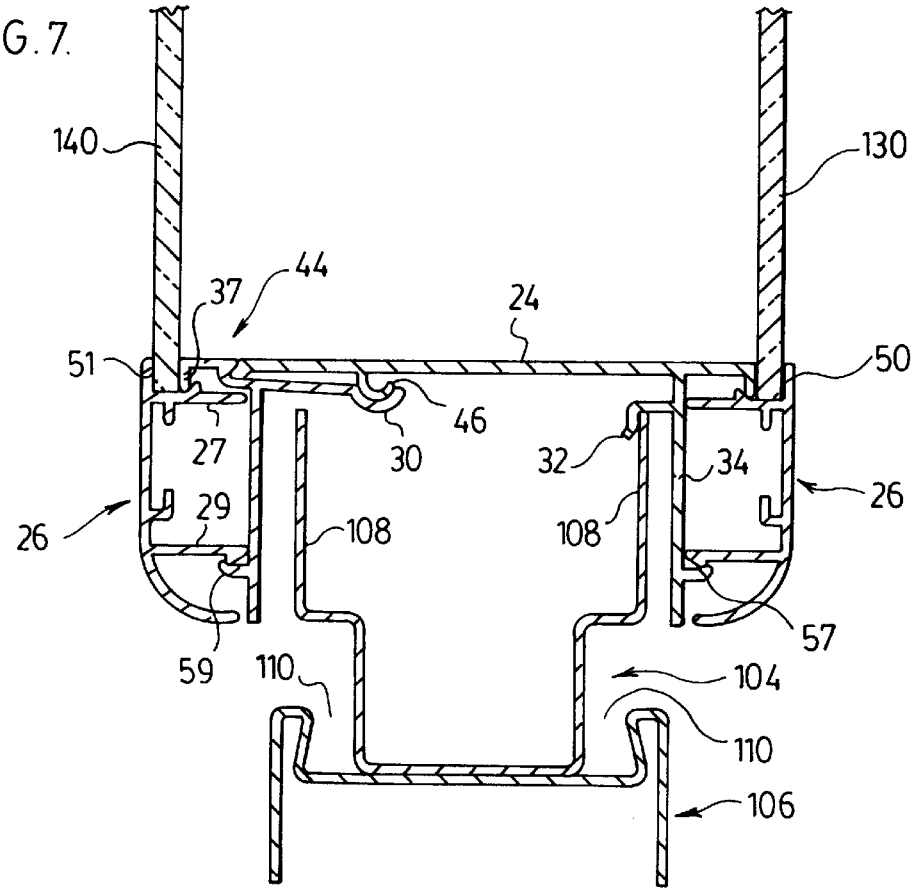
FIG. 7 is a partial sectional view of the lower portion of the insert module secured to a horizontal member of the office panel frame.

In the embodiment of FIG. 7, it can be seen that two glazed panes 130 and 140 are provided where each of these glazed panes are supported by the dominant and secondary component. Any loads exerted on the dominant or secondary component will be from the exterior of module towards the frame, and thus, provide a very safe structure. As such, common forces which may be exerted on the module during normal use of the system are unlikely to cause inadvertent removal or release of one of the components from the frame.

Figure 10:
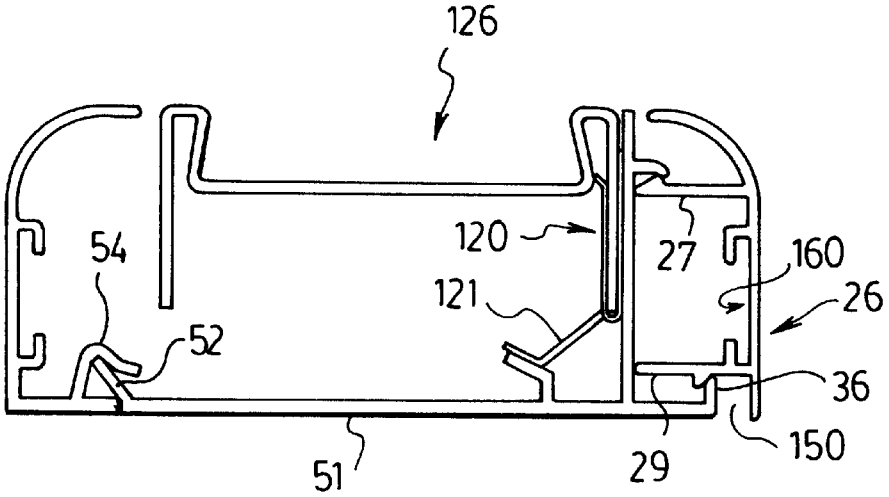
FIG. 10 is a vertical section through the upper portion of the insert module showing a horizontal member of the frame and part of the dominant and secondary components.

A further advantage of the structures of FIGS. 3 through 7 is that the dominant component 20 provides the securing surfaces for the secondary component 22. Preferably, these components at the bottom finished edge interior to the frame interlock with one another as shown by the overlap junction or joint 44 in FIG. 8. The secondary component includes a locating bead 47 which is received within the positioning slot 49 provided at the exposed edge of the attachment section 24. This overlap assures a very tight joint which is coplanar in the horizontal direction of the insert module. The insert module adjacent the vertical members is quite stiff, whereas the attachment section 24 in the center of the insert module is less rigid. By providing the overlapping and preferably interlocking joint, a high quality finish is provided between the secondary component and the dominant component, as the edges are forced to align. An accurate joint is also provided between the upper attachment section 51 and the secondary component 22 at the upper horizontal surface, as illustrated in FIG. 10. In this case, the hook 54 is in engagement with the continuous flange 52 and this relationship accurately locates these two components resulting in an unobtrusive seam therebetween (see FIG. 10).

The vertical seams are less subject to distortion, but include a shiplap type overlapping joint at the vertical interior edges of the module (see FIG. 9).

Figure 8:
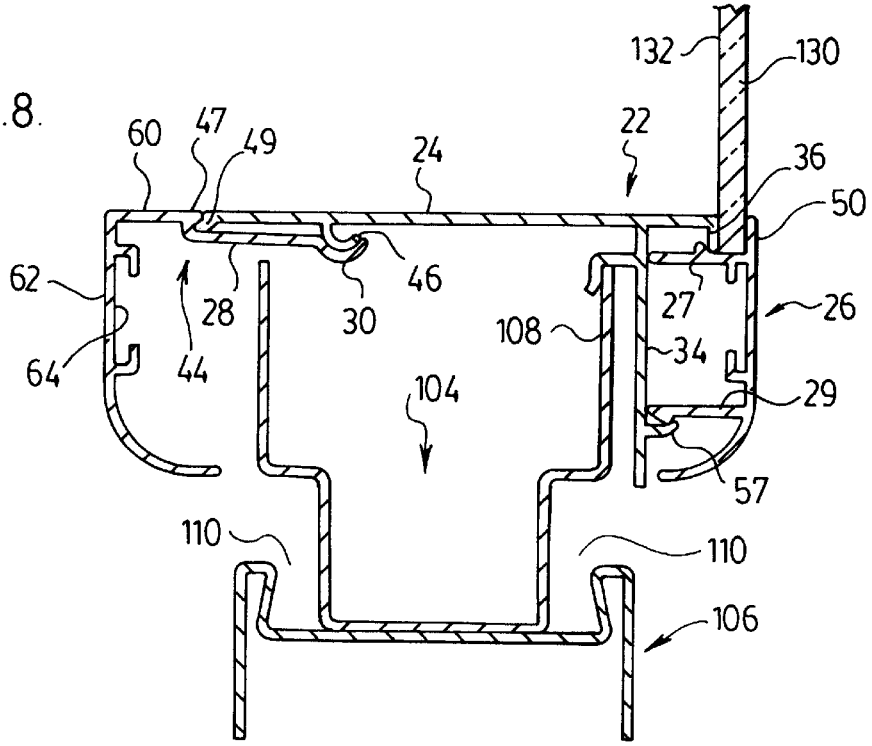
FIG. 8 is a sectional view similar to FIG. 7, where the module has a single glazed pane to one side of the panel.

The dominant component 20, opposite the side for engagement with the secondary component, has a downwardly extending flange 36 which cooperates with a cam and latch 57 provided on the leg 34 (see FIG. 8). A trim section 26 includes two cam legs 27 and 29 for locking behind the flange 36 and the cam and latch 57 provided on the dominant component. This arrangement provides a positive structural connection between the dominant component and the trim section 26. These components also cooperate to define, between the flange 36 and an exterior flange 48 of the trim section 26, a recess 50 for supporting and engaging the lower edge of a glazed pane. The upper edge of the dominant component, as shown in FIG. 10, includes a similar flange 136 and cam and latch 157 which engage the trim section 26. There is also a recess 150 for engaging the upper edge of the glazed pane. Either the upper or lower trim section is installed on the dominant component, the glazed pane inserted and the other trim section installed, thereby trapping the glass pane.

The trim section 26 includes on an interior surface thereof a slot arrangement 160 and a similar slot arrangement 64 is provided on the upper and lower horizontal segments of the secondary component 22. These slot arrangements engage and retain end plugs 59, shown in FIG. 2, which form part of the finished surface.

As shown in FIG. 7, the secondary component 22 can be of an alternate structure to provide a flange 37 similar to 36 and a cam and latch 59, whereby the same attachment section 24 may be secured to the secondary component and define a recess 51 for receiving the base of the glazed pane 140.

FIG. 9 shows vertical member 126 of the office panel frame attached to one of the horizontal members 104. The dominant component 20 includes a vertical finish defining member 70 which has a peripheral slot 72 for engaging the edge of a glazed pane and a through-the-panel extension member 74 having a bent portion 76 at the free end thereof for overlapping in a shiplap type joint with the secondary component. The secondary component 22 includes a vertical member 80 having a free edge 82 which overlaps and interacts with the end portion 76 of the extension portion 74. Vertical member 80 includes a finished surface 84 having a squared off end portion 86. This would be the construction of the vertical members of the dominant and secondary components for the structure of FIG. 8 where glazing is provided only at the exterior of the dominant portion. It can be appreciated that if glazing is provided at both edges, as shown in FIG. 7, the secondary component 22 would also include a slot similar to 72 for engaging the periphery of glazed pane secured by the secondary component.

An accurate junction is provided between components 76 and 82 at the vertical edge and results in an unobtrusive seam. Furthermore, the accuracy of the seam or joint is determined by the two components and the cooperation therebetween. This is also true with respect to the overlap joint 47 shown in FIG. 3, which can be held in close tolerances due to the fact that the secondary component directly engages and is supported by the dominant component.

As shown in FIG. 3, attachment sections 24 and 51, extension members 74 form a collar extending through the panel frame providing a finish surface for the light transmitting port.

In some cases, it may be desirable to only have a glazed pane supported by the secondary component. For example, if the insert module is only at a high point where there is little likelihood of applying inadvertent forces to the secondary component, the ease of removal and assembly of the secondary component to the dominant component can simplify cleaning of the glass pane. The secondary component can be partially released by pivotting the lower edge outwardly from the frame, releasing the spring arm 28. The secondary component continues to hang from the top hook and latch until removed. The pane can then be cleaned at ground level and reinstalled. The top hook and latch make reconnection simple as the latch flange 50 extends beyond the frame. In this form, the top of the secondary component binds with the frame limiting rotation movement and reducing the likelihood of inadvertent removal as an outward rotational movement followed by a lifting movement is required to release the secondary component.

With the module as shown, the outer faces of the insert module are preferably the same. The outer face of the glazed secondary component of FIG. 7 is the same as the outer face of the dominant component of FIG. 7. With this arrangement, all of the insert modules in an office panel frame do not have to be assembled from the same side of the frame. For example, high glazed modules having only a single pane may not be subject to inadvertent removal due to their high position, and the ability to quickly remove the secondary components with the glazed pane is preferred. In the same panel, a lower single glazed module may be subject to inadvertent removal and cleaning due to the lower position is not a problem. Therefore, the dominant component of the lower module with glazing could be used but inserted from the opposite side of the frame. The fact that the dominant components of the modules are inserted from opposite sides of the frame is not visually recognized at the exterior surface, which is of a common configuration. A different trim frame 26 can be secured to the upper dominant component if the slot for receiving the pane is undesired or cannot be satisfactorily filled to avoid significant visual impact. A single glazed module similar to the structure of FIG. 8 would allow a single pane to be associated with either the dominant or the secondary component.

It is desirable in many applications to only provide glazing to the exterior of an office panel on the dominant component. For example, a substantial cost saving can be realized by glazing only one side, and often the interior surface which is now open is satisfactory as a finished surface for the work space defined to that side of the office panel. Furthermore, there is also a maintenance consideration in that it is desirable to clean the glazed panes, and by having glazing only to one side of the office panel, both surfaces of the panes are accessible. The module maintains the assembled condition if accidental forces are exerted thereon due to the locking cooperation between the components and the face that removal requires two different forces in proper sequence Where twin glazing is used, as shown in FIG. 7, a full cleaning would require removal of the secondary component to clean the interior surface of the glazed pane provided on the secondary component as well as to expose the interior surface of the glazed pane of the dominant portion for cleaning. As mentioned above, glazing of the dominant component alone has the advantageous feature that the secondary component provides a positive lock of the dominant component in the frame, and therefore, any forces exerted on the interior surface of the glazed pane are opposed by both the dominant and the secondary component. Furthermore, the components engage opposite sides of the frame resulting in a high strength connection to the frame. In the case of double glazing, when the secondary component is removed, the downwardly extending leg 34 does provide a safety catch should the dominant component be partially released from the frame by disengaging of the spring clip. Furthermore, it can be appreciated that the dominant component will rotate about the hook 32 and result in a binding of the dominant portion with the upper horizontal member of the frame. This feature of the dominant portion is a result of the manner of assembly of the dominant portion in the frame, which includes an insert and drop type arrangement or two-step process which requires both insertion and downward movement.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. An office panelling system comprising a series of mechanically connected office panels defining an office work space, each of said panels having a support frame selectively covered by releasable elements applied to opposite sides of said frame and forming part of an exterior surface of the respective panel, said panels also including insert modules defining open or light transmitting ports through said panels, each insert module having a dominant rectangular frame component and a secondary rectangular frame component, said dominant rectangular frame component being releasably secured to said frame and providing a finish surface to one side of said frame, said secondary rectangular frame component being positioned to the opposite side of the frame and aligned with said dominant rectangular frame component and providing a finish surface on said opposite side of said frame, and wherein said secondary rectangular frame component is releasably secured to and supported by said dominant rectangular frame component.

2. An office panelling system as claimed in claim 1 wherein said dominant rectangular frame component includes a finish insert portion concealing the interior of said frame from view through said insert module.

3. An office panelling system as claimed in claim 1 wherein said dominant rectangular frame component includes a trim frame which includes a slot about the interior perimeter of said insert module which engages and retains a glazed pane.

4. An office panelling system as claimed in claim 1 wherein said secondary rectangular frame component includes a rectangular perimeter frame surrounding a light transmitting port.

5. An office panelling system as claimed in claim 4 wherein said secondary rectangular frame component includes a glazed pane across said light transmitting port.

6. An office panelling system as claimed in claim 1 wherein said dominant rectangular frame component and said secondary rectangular frame component cooperate to lock said components on a supporting frame whereby release of said dominant rectangular frame component from said supporting frame requires release of said secondary rectangular frame component from said dominant rectangular frame component.

7. An office panelling system as claimed in claim 6 wherein said light transmitting port defines an open passthrough port through said panelling system.

8. An office panelling system as claimed in claim 6 wherein each of said secondary and said dominant rectangular frame components support a glazed pane which forms part of said finish surface.

9. An office panelling system as claimed in claim 8 wherein each glazed pane is generally flush with an exterior surface of said office panelling system.

10. An office panelling system as claimed in claim 1 wherein said dominant rectangular frame component includes a downwardly extending leg which provides a safety catch which engages said frame and maintains said dominant rectangular frame component supported by said frame if said dominant rectangular frame component is accidentally partially released from said frame.

11. An insert module for providing a light transmitting port through an office panel of an office panelling system, said insert module having a dominant component and a secondary component, said secondary component releasably engaging and being supported from said dominant component in a manner to maintain alignment of said components, each component having a rectangular outer frame finish portion for defining the outer perimeter of said light transmitting port, said dominant component further including a fastening arrangement for engaging a frame of an office panel for supporting said module therefrom.

12. An insert module as claimed in claim 11 wherein said module includes a collar portion extending between said outer frames when said components are engaged and providing a finish surface of said light transmitting port between said outer frames.

13. An insert module as claimed in claim 12 wherein said collar is generally rectangular in shape.

14. An insert module as claimed in claim 12 wherein said collar is secured to and forms part of said dominant component and said secondary component is releasably secured from said dominant component by said secondary component releasably engaging said collar on top and bottom surfaces thereof.

15. An insert module as claimed in claim 14 wherein said collar and secondary component define a hook and lip arrangement at said upper edge whereby said secondary component hangs from said collar and a spring latch arrangement at said bottom surface.

16. An insert module as claimed in claim 15 wherein said secondary component and said collar interact at a bottom interior edge of said collar to define a generally flush surface at a junction of said collar and said secondary component.

17. An insert module as claimed in claim 16 wherein said secondary component and said collar overlap at said junction.

18. An insert module as claimed in claim 11 wherein at least one of said dominant component and said secondary component includes a glazed pane across said light transmitting port.

19. In combination an insert module and an office panel of an office panelling system, said insert module defining a light transmitting port through said office panel, said insert module having a dominant component and a secondary component, said secondary component releasably engaging said dominant component and being supported from said dominant component in a manner to maintain alignment of said components, each component having a rectangular outer frame finish portion for defining the outer perimeter of said light transmitting port, said dominant component further including a fastening arrangement engaging a frame of said office panel and supporting said module from the frame with said dominant component on one side of said frame and said secondary component on the opposite side of said frame.

20. In combination as claimed in claim 19 wherein said dominant component and said secondary component cooperate whereby said dominant component can not be released from said frame without releasing said secondary component from said dominant component and at least one of said dominant component and said secondary component includes a secured glazed pane across said light transmitting port.

* * * * *